US012054323B2

(12) United States Patent
Joseph et al.

(10) Patent No.: US 12,054,323 B2
(45) Date of Patent: Aug. 6, 2024

(54) MULTI-UNIT STACKABLE DISPLAY WITH SHELF-READY PACKAGING

(71) Applicant: Mars, Incorporated, McLean, VA (US)

(72) Inventors: Mark Joseph, Batley (GB); György Greksza, Budapest (HU)

(73) Assignee: Mars, Incorporated, McLean, VA (US)

( * ) Notice: Subject to any disclaimer, the term of this patent is extended or adjusted under 35 U.S.C. 154(b) by 0 days.

(21) Appl. No.: 17/791,404

(22) PCT Filed: Jan. 13, 2021

(86) PCT No.: PCT/US2021/013237
§ 371 (c)(1),
(2) Date: Jul. 7, 2022

(87) PCT Pub. No.: WO2021/146283
PCT Pub. Date: Jul. 22, 2021

(65) Prior Publication Data

US 2023/0035223 A1 Feb. 2, 2023

Related U.S. Application Data

(60) Provisional application No. 62/960,448, filed on Jan. 13, 2020.

(51) Int. Cl.
*B65D 5/54* (2006.01)
*B65D 5/52* (2006.01)

(52) U.S. Cl.
CPC ..... *B65D 5/5445* (2013.01); *B65D 5/5253* (2013.01)

(58) Field of Classification Search
CPC ..... B65D 5/5445; B65D 5/5253
(Continued)

(56) References Cited

U.S. PATENT DOCUMENTS 3,002,613 A * 10/1961 Merkel ..... B65D 5/542 229/122
3,090,483 A 5/1963 Altree et al.
(Continued)

FOREIGN PATENT DOCUMENTS

| | | | |
|---|---|---|---|
| CN | 205087244 | U | 3/2016 |
| WO | 9831593 | A1 | 7/1998 |
| WO | 2004063031 | A1 | 7/2004 |

OTHER PUBLICATIONS

International Search Report and Written Opinion issued in International Application No. PCT/US2021/013237, dated Apr. 2, 2021 and Mar. 22, 2021, respectively (7 pages).
(Continued)

*Primary Examiner* — Robert J Hicks
*Assistant Examiner* — Sanjidul Islam
(74) *Attorney, Agent, or Firm* — Bookoff McAndrews, PLLC

(57) ABSTRACT

A display apparatus (10) includes multi-unit shelf-ready packaging that is configurable between a closed position for shipping and an open position for display on a store shelf. The display apparatus (10) includes a first tray (20) and a second tray (30), and at least one tear panel (40) disposed between the first and second trays. When the tear panel (40) is removed, the first and second trays and associated products are positioned in a back-to-back, side-by-side or vertically stacked configuration on a shelf.

20 Claims, 11 Drawing Sheets

(58) Field of Classification Search
USPC ..... 206/746; 220/23.86, 23.83
See application file for complete search history.

(56) References Cited

U.S. PATENT DOCUMENTS

| | | | | |
|---|---|---|---|---|
| 4,000,811 | A | 1/1977 | Hardison et al. | |
| 4,424,901 | A * | 1/1984 | Lanier | B65D 71/34 206/141 |
| 6,702,115 | B1 * | 3/2004 | Roper | B65D 5/5061 206/427 |
| 2007/0295796 | A1 * | 12/2007 | Sutherland | B65D 5/5253 229/120.09 |
| 2009/0302098 | A1 | 12/2009 | Learn | |
| 2013/0105355 | A1 | 5/2013 | Keefe | |
| 2017/0225823 | A1 | 8/2017 | Forward et al. | |

OTHER PUBLICATIONS

Xie Qi, "Carton packaging design," Printing Industry Press Co., Ltd, published Aug. 1, 2008, pp. 64-66.

* cited by examiner

MULTI-UNIT STACKABLE DISPLAY WITH SHELF-READY PACKAGING

CROSS-REFERENCE TO RELATED APPLICATIONS

This application is a U.S. national phase entry under 35 U.S.C. § 371 of International Application No. PCT/US2021/013237, filed on Jan. 13, 2021, which claims priority to U.S. Provisional Application 62/960,448 filed Jan. 13, 2020, the contents of which are incorporated by reference in their entirety.

FIELD

The presently disclosed subject matter relates to product packaging, and more particularly to multi-unit, shelf-ready packaging with stackable display configurations and associated methods.

BACKGROUND

Displays are often used in brick and mortar retail establishments to showcase consumer products in an attractive and convenient manner. In general, merchandising displays are box-like structures with trays, bins, or shelves sized to hold the merchandise for sale. It is preferable that the displays portray merchandise in an aesthetically pleasing manner, draw attention to specific merchandise, and drive sales. In particular, merchandise displays that are multi-dimensional, colorful, and an appropriate height can enhance the attractiveness of product being displayed and engage shoppers.

Conventional displays of packaged products for display on store shelves often require products to be packaged in a first configuration for bulk shipping to a point of sale, such as a palletized stack of wrapped bulk cases or shipment in large boxes. The cases or boxes of individual units are then unpacked from the pallet or box at the point of sale and placed on shelves as individual units. However, this approach is labor intensive, increases freight weight and is not efficient as it requires manual unpacking of cases or boxes and separate shelf stocking at the retail location.

To overcome these deficiencies, shelf-ready packaging can include multi-unit, or multi-pack, shipping cases that are unpacked from a pallet and placed directly on store shelves without having to unpack individual units. Such multi-pack displays include more than one retail unit in the case. Upon removing a multi-pack shelf-ready package from a pallet or shipping container, the entire shelf-ready package can be placed directly on a store shelf without removing the individual units from the package. The shipping package thus also serves as a display tray or box that can be placed directly on a store shelf.

Conventional multi-unit shelf-ready packaging is generally inadequate for vertical stacking applications such as situations where a single unit retail package has a vertical height less than an allotted retail shelf space height or an allotted floor space height. In such applications, to efficiently maximize product placement, it is desirable to provide a vertically stacked configuration where multiple rows of products are stacked vertically relative to each other to fill the allotted volume. However, conventional multi-unit shelf-ready packaging configurations generally do not allow displays to be stacked vertically in a stable, efficient and cost effective manner. Additionally, conventional multi-unit shelf-ready packaging configurations require complex manipulation of excess packaging materials to place the units in a vertically stackable configuration. Conventional multi-unit shelf-ready packaging configurations also produce significant packaging material waste when configured from a palletized shipping configuration to a shelf-ready retail display configuration. Such waste leads to unnecessary material expense and negative environmental impacts.

What is needed are multi-unit stackable displays with shelf-ready packaging that are easily configurable between a closed position for shipping and an open position for shelf-ready display at a brick and mortar retail sale location. Also needed are multi-unit shelf-ready packaging displays that are vertically stackable relative to like displays in the open position and that minimize waste associated with conversion from the closed to the open position.

SUMMARY

One aspect of the present disclosure provides shelf-ready packaging display apparatus.

In some aspects of the disclosure, which may be combined with any other aspect listed herein unless specified otherwise, a display apparatus is provided. The display apparatus includes a case configured to house two rows of products in a side-by-side or stacked orientation. The case includes a first tray positioned to retain the first row and a second tray positioned to retain the second row. The tray is configured to be opened by a user by removing at least one tear-away panel between the first and second trays. The first tray and associated row of products may then be separated from the second tray and associated row of products. The separated first and second trays may then be positioned at a retail point of sale on a shelf in a side-by-side, a back to back or a vertically stacked orientation.

In a second aspect of the disclosure, which may be combined with any other aspect listed herein unless specified otherwise, a display is provided. Each product of the first set of products in the display includes a first height.

In a third aspect of the disclosure, which may be combined with any other aspect listed herein unless specified otherwise, a display is provided. Each product of the second set of products in the display includes a second height.

In a fourth aspect of the disclosure, which may be combined with any other aspect listed herein unless specified otherwise, a display is provided. In some embodiments, the first height and the second height are substantially equal.

In a fifth aspect of the disclosure, which may be combined with any other aspect listed herein unless specified otherwise, a display is provided. In some embodiments, the first height and the second height are not equal.

In a sixth aspect of the disclosure, which may be combined with any other aspect listed herein unless specified otherwise, a display is provided. In some embodiments, the first tray is supported by the second set of products when the first tray is stacked above the second tray.

In a seventh aspect of the disclosure, which may be combined with any other aspect listed herein unless specified otherwise, a display is provided. In some embodiments, the second tray is supported by the first set of products when the second tray is stacked above the first tray.

In an eighth aspect of the disclosure, which may be combined with any other aspect listed herein unless specified otherwise, a display is provided. In some embodiments, the first tear panel includes a first pull slot and a second pull slot.

In a ninth aspect of the disclosure, which may be combined with any other aspect listed herein unless specified otherwise, a display is provided. In some embodiments, the display further comprises a front side, back side, right side, left side, top and bottom.

In a tenth aspect of the disclosure, which may be combined with any other aspect listed herein unless specified otherwise, a display is provided. In some embodiments, the primary tear panel is disposed on the front side and right side.

In an eleventh aspect of the disclosure, which may be combined with any other aspect listed herein unless specified otherwise, a display is provided. In some embodiments, the secondary tear panel is disposed on the left side.

In a twelfth aspect of the disclosure, which may be combined with any other aspect listed herein unless specified otherwise, a display is provided. In some embodiments, the display comprises a fold line on the secondary tear panel, wherein the first tray is pivotable relative to the second tray along the fold line on the secondary tear panel when the secondary tear panel is on the display.

In a thirteenth aspect of the disclosure, which may be combined with any other aspect listed herein unless specified otherwise, a display is provided. In some embodiments, the display comprises a rear fold defined on the back side of the display, wherein the first tray is pivotable relative to the second tray along the rear fold when the primary and secondary tear panels are both removed from the display.

In a fourteenth aspect of the disclosure, which may be combined with any other aspect listed herein unless specified otherwise, a display is provided. In some embodiments, display apparatus, comprises a box having a first tray and a second tray, wherein the first tray is inverted relative to the second tray, the box including a front side, back side, left side, right side, top and bottom; a primary tear panel disposed between the first and second trays; a secondary tear panel disposed between the first and second trays adjacent the primary tear panel; and a rear fold defined on the back side of the box between the first and second trays, wherein the first and second trays are vertically stackable.

In a fifteenth aspect of the disclosure, which may be combined with any other aspect listed herein unless specified otherwise, a display is provided. In some embodiments, the primary tear panel is disposed on the front side and right side of the box In a sixteenth aspect of the disclosure, which may be combined with any other aspect listed herein unless specified otherwise, a display is provided. In some embodiments, the secondary tear panel is disposed on the left side of the box In a seventeenth aspect of the disclosure, which may be combined with any other aspect listed herein unless specified otherwise, a display is provided. In some embodiments, the primary tear panel is disposed on the front side and left side of the box.

In an eighteenth aspect of the disclosure, which may be combined with any other aspect listed herein unless specified otherwise, a display is provided. In some embodiments, the secondary tear panel is disposed on the right side of the box.

In a nineteenth aspect of the disclosure, which may be combined with any other aspect listed herein unless specified otherwise, a method of displaying a product is provided. The method includes providing a case including a first tray and a second tray, wherein the first tray is inverted relative to the second tray, the case including a primary tear panel and a secondary tear panel; placing a first set of products in the first tray and a second set of products in the second tray, wherein the first set of products is inverted relative to the second set of products; shipping the case to a point of sale; removing the primary and secondary tear panels; separating the first tray and first set of products from the second tray and second set of products; and vertically stacking the first tray and first set of products above the second tray and second set of products.

In a twentieth aspect of the disclosure, which may be combined with any other aspect listed herein unless specified otherwise, a method of displaying a product is provided. The method includes wherein the second set of products supports the first tray and first set of products in the vertically stacked position.

In light of the present disclosure and the above aspects, it is therefore an advantage of the present disclosure to provide a shelf-ready packaging display that can be easily converted from a closed shipping configuration to an open display configuration.

The advantages discussed herein may be found in one, or some, and perhaps not all of the aspects disclosed herein. Additional features and advantages are described herein, and will be apparent from, the following Detailed Description and the Figures.

BRIEF DESCRIPTION OF THE DRAWINGS

The accompanying drawings, which are incorporated herein and constitute part of this specification, illustrate certain preferred aspects of the invention, and, together with the general description given above and the detailed description given below, serve to explain the features of the invention. In the drawings.

DETAILED DESCRIPTION

While the invention is described in connection with certain preferred aspects, it is not intended that the present invention be so limited. On the contrary, it is intended to cover all alternatives, modifications, and equivalent arrangements as may be included within the spirit and scope of the invention as defined by the appended claims.

FIGS. 1-11 provide illustrative, non-limiting aspects of the present invention setting forth an exemplary packaging and display apparatus and associated methods. Certain terminology is used herein for convenience only and is not to be taken as a limitation on the present invention. While the following describes certain illustrative aspects of the present invention, it should be understood, based on this disclosure that the invention is described by the claims, and is not limited by the aspects described herein.

The present disclosure provides product displays that may be pre-assembled, packed, shipped, and easily deployed in any of various retailers, wholesalers, and other brick-and-mortar establishments.

Figure 1:
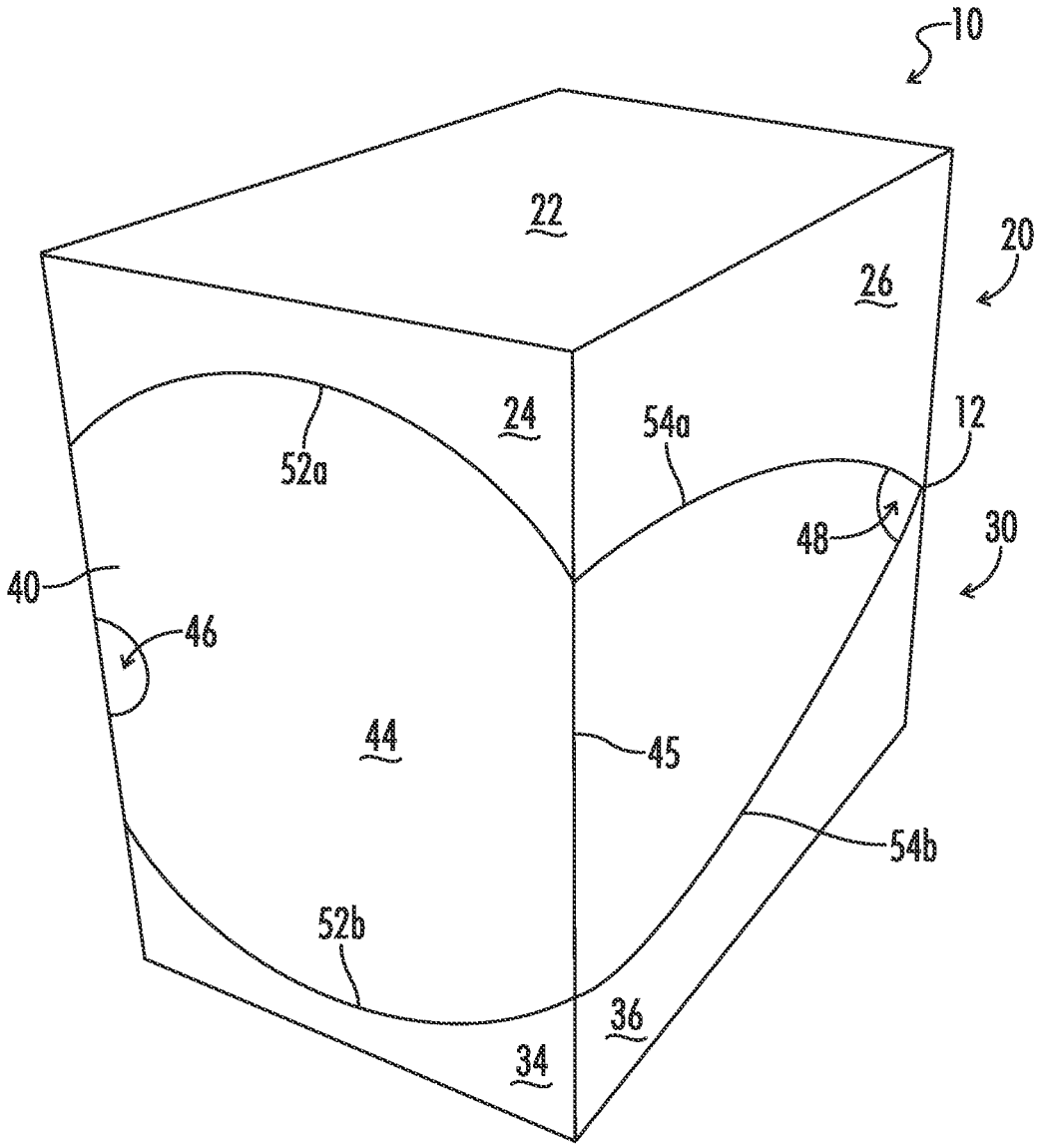
FIG. 1 is a right side perspective view of an embodiment of a multi-unit shelf-ready packaging display in accordance with the present disclosure.
Figure 5:
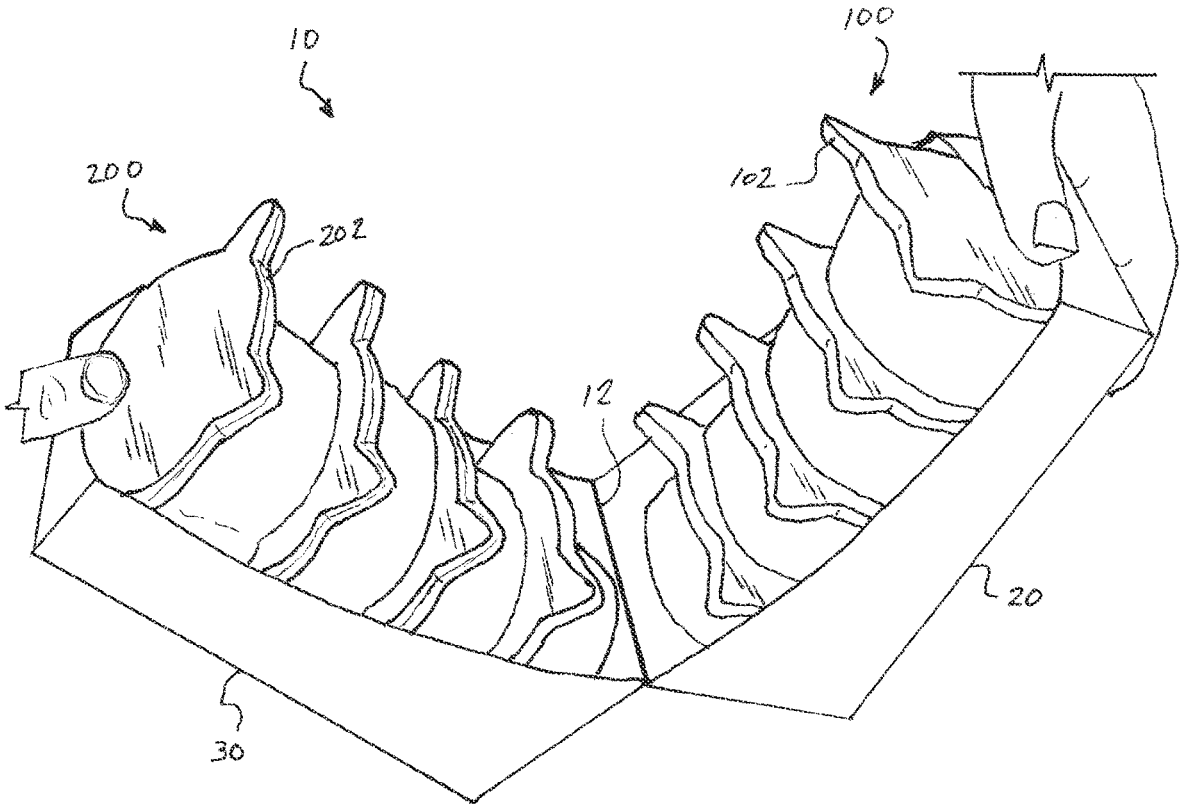
FIG. 5 is a perspective view of an embodiment of a multi-unit shelf-ready packaging display in a partially open configuration in accordance with the present disclosure.

Referring to the drawings, FIG. 1 shows an example of a multi-unit shelf-ready packaging display apparatus 10 in a closed position. Display 10 shown in FIG. 1 includes a container box or case configured to house multiple units of retail products inside the case. Display 10 may be referred to as a multi-pack case or a multi-unit case. Display 10 is shown in FIG. 1 in a closed position for shipment on a pallet or in a larger shipping container such as a crate or box. Upon delivery to a brick and mortar retail store, each display 10 may be removed from a pallet or other shipment container and opened for display directly onto a store shelf Display 10 includes a case for storing two or more units of individually packaged items for sale. Display 10 includes an integral first tray 20 and an integral second tray 30 formed by the case material. For example, first and second trays 20, 30 include integral portions of the container box shown in FIG. 1 and are revealed during the reconfiguration of the display 10 from a closed position as seen in FIG. 5. First and second trays 20, 30 are positioned such that each tray is pre-packaged with a plurality of products oriented for display when first and second trays 20, 30 are separated.

Figure 2:
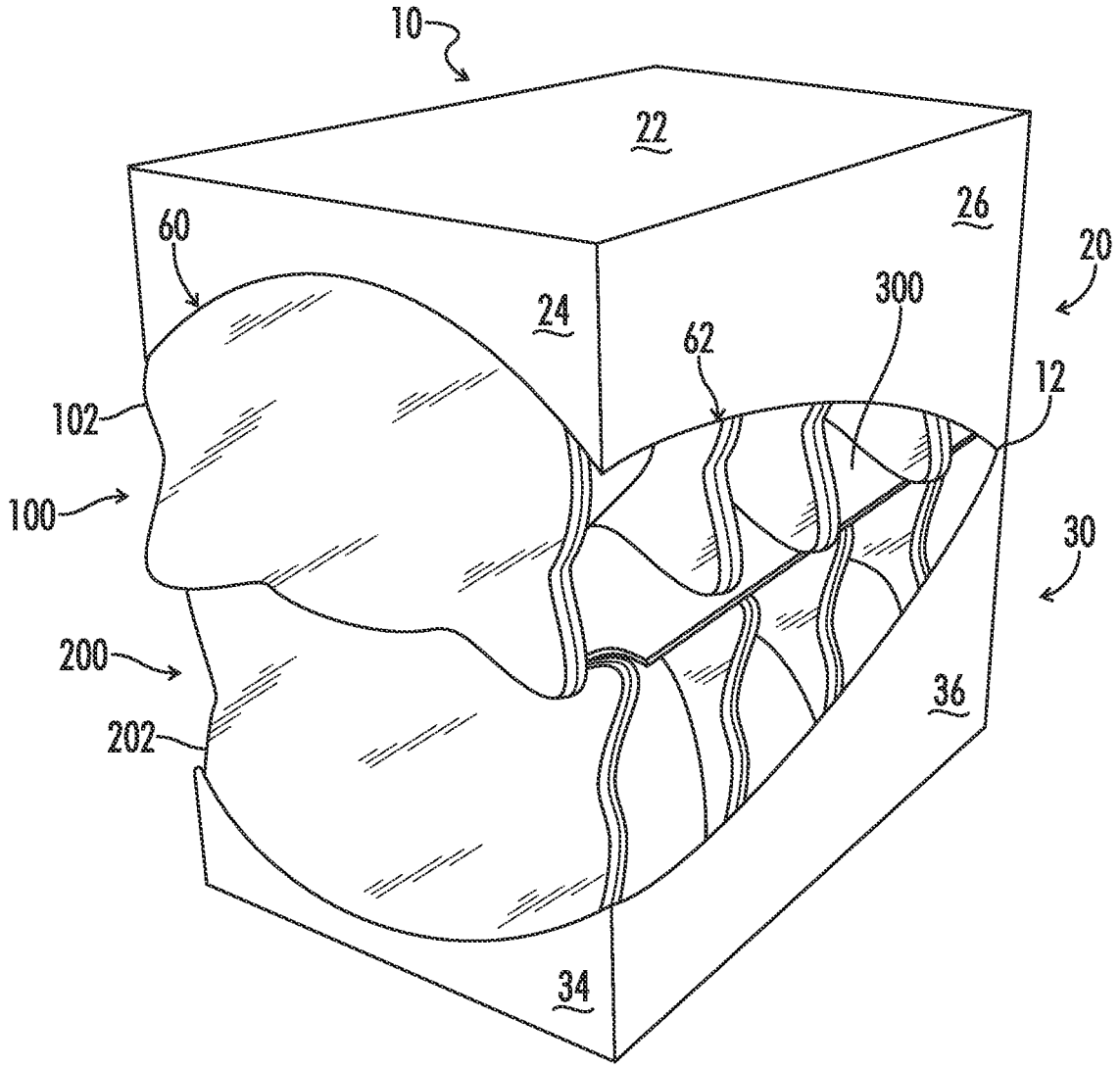
FIG. 2 is a right side perspective view of an embodiment of a multi-unit shelf-ready packaging display in a partially open configuration in accordance with the present disclosure.
Figure 3:
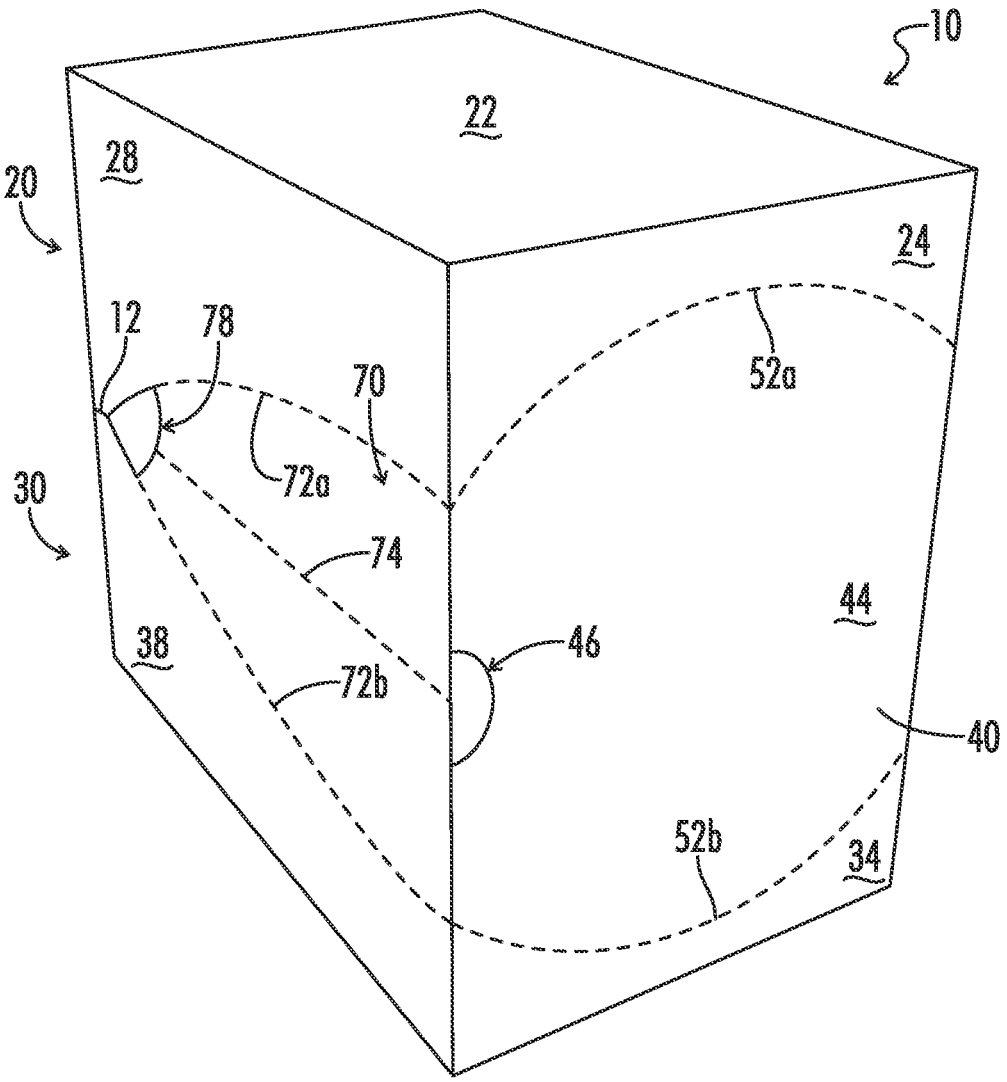
FIG. 3 is left side perspective view of an embodiment of a multi-unit shelf-ready packaging display in accordance with the present disclosure.

Referring to FIG. 1 and FIG. 2, first tray 20 includes a first tray front 24 and a first tray right side 26. Second tray 30 includes a second tray front 34 and a second tray right side 36. As shown in FIG. 3, first tray 20 also includes a first tray left side 28, and second tray 30 includes a second tray left side 38. Display 10 is generally formed in the shape of a rectangular box in some embodiments when in the closed position.

To open display 10 from a closed position to an open position, a tear panel 40 may be manually removed. Tear panel 40 includes an integral portion of display 10 with perforated edges defining tear lines to facilitate removal of tear panel 40 from display 10. In some embodiments, display 10 includes both a primary tear panel 40 and a secondary tear panel 70 that may be selectively removed separately to reconfigure the display 10 from the closed position to an open position.

In some embodiments, tear panel 40 includes a primary tear panel side section 42 and a primary tear panel front section 44. Primary tear panel side section 42 and primary tear panel front section 44 are formed from a single portion of the case wall material folded along a corner 45 between the display front and the display side as shown in FIG. 1. Tear panel 40 is configured to be manually torn away from display 10 along perforations defined in the case wall material.

To facilitate removal of tear panel 40, a first pull slot 46 is defined in primary tear panel front section 44 on the side opposite folded corner 45. First pull slot 46 defines a void in the wall of display 10, allowing a user to insert a finger or a tool to manually pull tear panel 40 away from the box. A second pull slot 48 is defined in primary tear panel side section 42 opposite folded corner 45 in some embodiments. As such, a user may engage first and second pull slots 46, 48 and pull tear panel 40 away from the display 10 by pulling toward folded corner 45. Alternatively, a user may remove tear panel 40 using only first pull slot 46 or second pull slot 48.

To remove the primary tear panel 40, a user may manually engage first and second pull slots 46, 48 and pull away from the display 10, thereby causing primary tear panel 40 to tear away from display 10 along predefined seams or perforations in the wall material of the container box. For example, the front face of display 10 in a closed position includes an upper primary tear panel front tear line 52*a* and a lower primary tear panel front tear line 52*b*. Each tear line includes a perforation, indentation or predefined scoring line in the wall material to facilitate tearing the primary tear panel away from the display 10. As a user engages first pull slot 46 and pulls away from the box, the primary tear panel front section 44 tears away from the box along both upper and lower primary tear panel front tear lines 52*a*, 52*b*.

Similarly, the side face of display 10 includes an upper primary tear panel side tear line 54*a* and a lower primary tear panel side tear line 54*b*. Each tear line includes a perforation, indentation or predefined scoring line in the wall material to facilitate tearing the primary tear panel away from the display 10. As a user engages second pull slot 48 and pulls away from the box, the primary tear panel side section 42 tears away from the box along both upper and lower primary tear panel side tear lines 54*a*, 54*b*. Although the primary tear panel side section 42 is shown on the right side of the display 10, in other embodiments the configuration may be reversed, and the side tear panel 42 is positioned on the left side of the display 10. In such configurations, the corresponding tear line and pull slot features are also reversed.

Each tear line includes a perforation, indentation or predefined scoring line in the wall material to facilitate tearing the primary tear panel away from the box. As a user engages second pull slot 48 and pulls away from the box, the primary tear panel side section 42 tears away from the box along both upper and lower primary tear panel side tear lines 54*a*, 54*b* and upper and lower primary tear panel front tear lines 52*a*, 52*b*. The removed tear panel 40 may be discarded following removal.

After primary tear panel 40 is removed from display 10, products contained within the container are visible in a packed configuration. For example, as shown in FIG. 2, a first set or first row of products 100 is visible stacked above a second set or second row of products 200 after primary tear panel 40 is removed. A first window 60 is defined on the front face of the container, and a side window 62 is defined on the side face of the container. Additionally, after removal of the primary tear panel 40, the upper portion of the container is transformed into a first tray 20, and the lower portion of the container is transformed into a second tray 30. Each of the first and second trays 20, 30 comprise shelf-ready packaging that can be positioned directly onto a store shelf with products already positioned in each respective tray properly oriented for display and sale. Additionally, the first and second trays 20, 30 are configured such that each may tray and products be vertically stacked relative a like tray and products.

Figure 8:
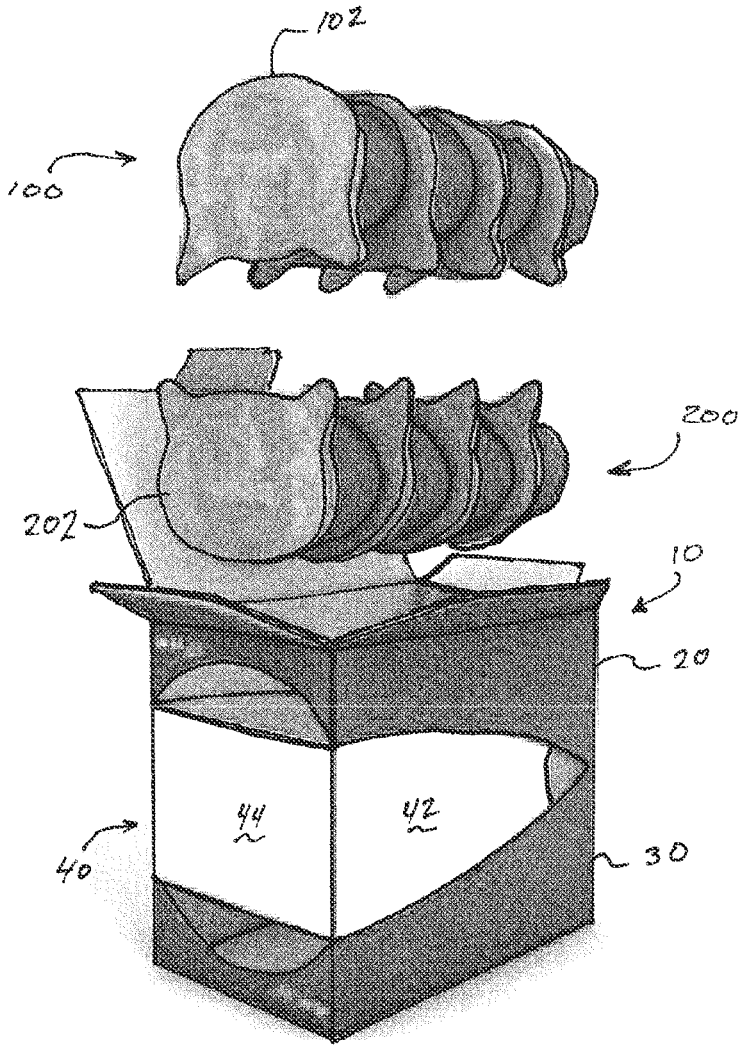
FIG. 8 is a partially exploded right side perspective view of an embodiment of a multi-unit shelf-ready packaging display in accordance with the present disclosure.

As shown in FIG. 2, first tray 20 is generally inverted relative to second tray 30 in a packed configuration. For example, as shown in FIG. 8, first and second rows 100, 200 of products 102, 202 are inserted into the display 10. For insertion, first row 100 is generally inverted relative to second row 200 such that first row 100 will be properly aligned in first tray 20 and second row 200 will be properly aligned in second tray 30 when display 10 is opened. In some embodiments, an interlayer 300 is positioned between the first and second row of products 100, 200 inside the display 10. Interlayer 300, shown in FIG. 2, includes a single sheet of material positioned to separate first and second sets of products 100, 200 in the packaged configuration. In other embodiments, interlayer 300 is not necessary and may be omitted from the packaged configuration to save weight and material.

Figure 6:
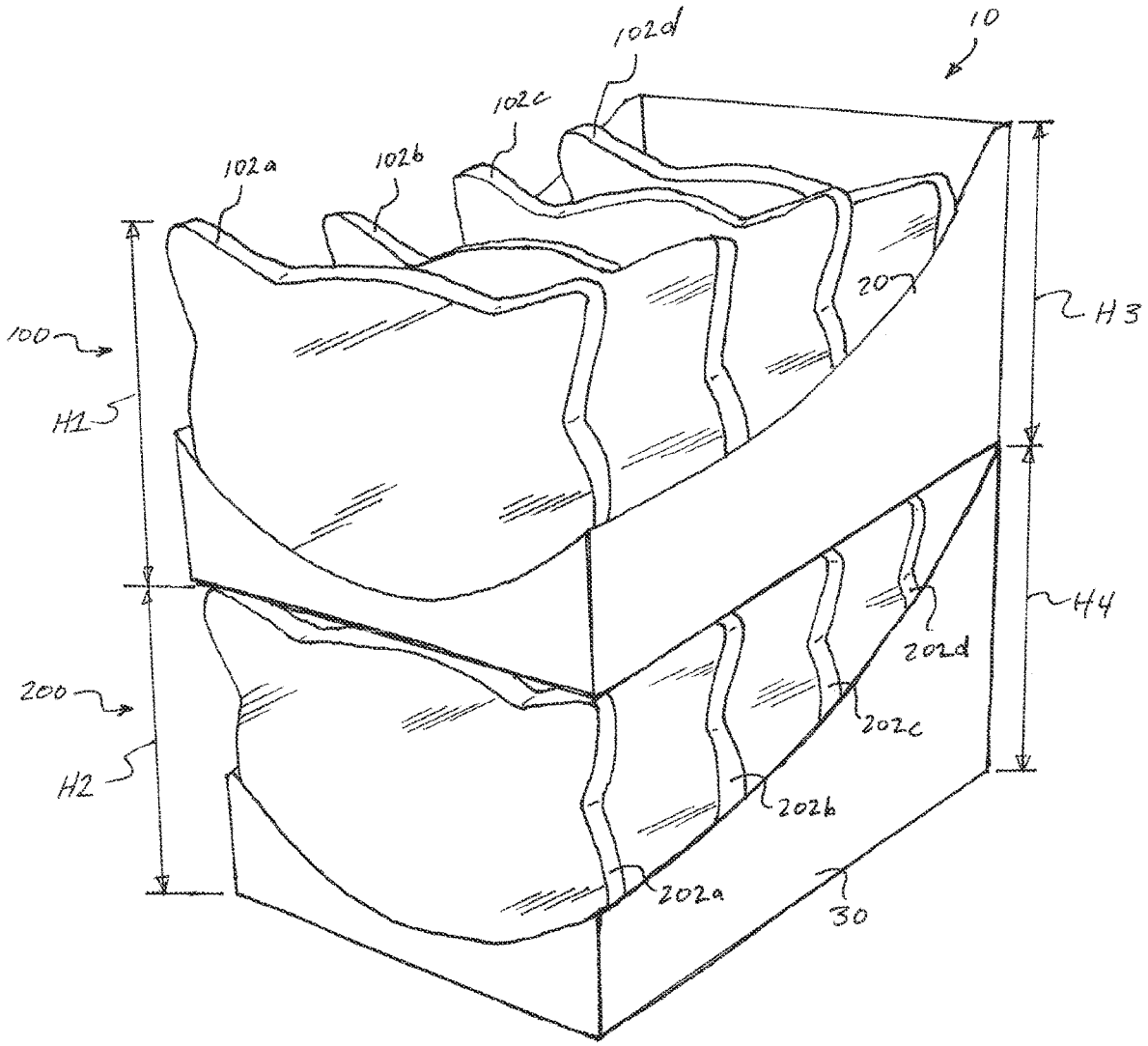
FIG. 6 is a right side perspective view of an embodiment of a multi-unit shelf-ready packaging display having first and second trays vertically stacked in accordance with the present disclosure.

Referring to FIG. 3, a left side perspective view of an embodiment of a display 10 in a closed configuration is shown in accordance with the present disclosure. Display 10 includes a secondary tear panel 70 on the left side of the box. Alternatively, in a reverse configuration, secondary tear panel 70 may be positioned on the right side of the box. Secondary tear panel 70 may be removed from the display 10 when unpacking the first and second trays 20, 30 before or after primary tear panel 40 is removed. A third pull slot 78 is defined on secondary tear panel 70 opposite the primary tear panel 40. A user may engage third pull slot 78 to lift secondary tear panel 70 away from the display and to remove secondary tear panel 70. To fully separate first and second trays 20, 30 for vertical stacking as shown in FIG. 6, secondary tear panel 70 must be removed in some embodiments.

Referring further to FIG. 3, secondary tear panel 70 includes an upper secondary tear panel tear line 72*a* and a lower secondary tear panel tear line 72*b* opposite the upper secondary tear panel tear line 72*a*. Each tear line includes a perforation, indentation or predefined scoring line in the wall material to facilitate tearing the primary tear panel away from the box. To remove secondary tear panel 70, a user engages third pull slot 78 and pulls the panel away from the box. The secondary tear panel 70 tears away from the box along both upper and lower secondary tear panel tear lines 72*a*, 72*b*. Secondary tear panel 70 as shown in FIG. 3 is configured for tearing from back to front, but in other embodiments, secondary tear panel may also be configured for tearing from front to back.

A rear fold 12 is defined along the back face of the display 10, as shown in FIG. 5. In some embodiments, rear fold 12 includes a crease, perforation, indentation or predefined scoring line in the wall material. Rear fold 12 extends along the back wall of the display 10 between the opposing sides of each tray. Rear fold 12 provides a predefined position for first and second trays 20, 30 to be folded relative to each other or alternatively torn apart as the display 10 is opened, as shown for example in FIG. 5.

Upon removing both the first and second tear panels 40, 70, first and second trays 20, 30 may pivot along rear fold 12 as shown in FIG. 5. Rear fold 12 forms a living hinge in some embodiments such that first and second trays are maintained in a back-to-back orientation relative to each other. Such an orientation may be a shelf-ready configuration where a back-to-back display is desired. Alternatively, upon opening the display 10 as shown in FIG. 5, first and second panels may be fully separated by tearing the wall material along rear fold 12, thereby separating first and second trays 20, 30 and associated products positioned in each tray.

Also shown in FIG. 3, first tray 20 incudes a first tray left side 28, and second tray 30 includes a second tray left side 38. First tray left side 28 and second tray left side 38 meet at rear fold 12, which forms a boundary between first and second trays 20, 30. During opening of the display 10, first and second trays 20, 30 may be folded apart along rear fold 12, as shown in FIG. 5 after first and second tear panels 40, 70 are removed. Once folded apart as shown in FIG. 5, first and second trays 20, 30 may be displayed on a shelf in a double-sided configuration with a first set of products 100 in first tray 20 facing a first direction and a second set of products 200 in second tray 30 facing in a second direction.

In some additional applications, is desirable to orient display 10 in a vertically stacked configuration. For such applications, a display 10 may be opened, as shown in FIG. 5 after removing first and second tear panels 40, 70. To achieve this configuration, first and second tear panels 40, 70 are removed, and first and second trays are torn apart from each other along fold line 12 from the position shown in FIG. 5. Once the first and second trays 20, 30 are fully separated, first tray 20 and its associated first row 100 of first products 102 may be stacked directly on top of the second tray 30 and its associated second row 200 of second products 202, or vice versa, as shown in FIG. 6.

Referring further to FIG. 6, in some embodiments, a first tray 20 and first products 102*a*-102*d* are stacked relative to second tray 30 and second products 202*a*-202*d*. The products included in each tray are dimensioned such that a tray and its products may be placed directly above and be supported by another like tray and like products in a vertically stacked configuration, shown for example in FIG. 6. Because the upper tray and products are supported by the lower tray and products, the upper tray may remain supported and stable even if one or more of the products in the lower tray are removed by a customer. Generally, during use, a customer will be more likely to remove the products from the upper tray first. When the upper tray is depleted, a substitute tray and products may be positioned above the lower tray and its products to restock the shelf. When both trays of products are depleted, substitute upper and lower trays may be repositioned with products on the shelf in a vertically stacked configuration.

To facilitate stable vertical stacking of the multi-unit shelf-ready packaging displays, each individual product unit disposed in the first or second tray includes a packaged height. For example, first product 102*a* includes a height H1. In some embodiments, each first product unit 102*a*-102*d* includes the same height H1. Second product 202*a* includes a second height H2. In some embodiments, each second product unit 202*a*-202*d* includes the same height H2. First and second heights H1 and H2 are substantially equal in some embodiments. First height H1 is the height of the upper edge of first product 102*a* above the bottom surface of first tray 20. Similarly, second height H2 is the height of the upper edge of second product 202*a* above the bottom surface of second tray 30. First tray 20 includes a first rear wall height H3 defined as the height along the rear wall of first tray 20. Second tray 30 also includes a second rear wall height H4 defined as the height along the rear wall of second tray 30.

In some embodiments, each unit in second products 202*a*-202*d* includes the same height H2, and rear wall height H4 on second tray 30 formed by the case material is substantially equal to the height H2 of each unit in second products 202*a*-202*d*. As such, second products 202*a*-202*d* and the rear wall on second tray 30 form a substantially level support against which the underside of first tray 20 may be positioned in a vertically stacked configuration, as shown in FIG. 6. The upper edge of each unit in second products 202*a*-202*d* supports the underside of first tray 20. Additionally, the rear wall on second tray 30 also supports the underside of first tray 20. First tray 20 may rest on top of second products 202*a*-202*d* and second tray 30 simultaneously. Alternatively, in some embodiments, first tray 20 may rest on the upper edges of second products 202*a*-202*d* standing alone.

More specifically, in some embodiments, the individual products included in the second set of products 200 each include a height H2 substantially equal to the desired stacking height for supporting the first tray 20 and its corresponding first set of products 100. In some embodiments, each unit of the second set of products 200 includes a uniform height H2 such that the tops of the units form a substantially level horizontal plane for supporting first tray 20. The weight of the first tray 20 and the multiple individual units contained therein is supported by the second tray below it and the upper edges of the multiple individual units disposed in the second tray 30. In further embodiments, each of the first set of products 100 also includes the same uniform height H1 so that multiple trays from multiple displays 10 may be vertically stacked.

In other embodiments, the height H1 of the first set of products is not equal to the height H2 of the second set of products. For example, a display 10 may contain a first row of products having a first height and a second row of products having a second height. However, as set forth in this disclosure, first and second trays in such embodiments could still be placed in a vertically stacked configuration. In additional embodiments, each unit of the first set of products 100 includes the same height H1. Additionally, each unit of the second set of products 200 includes the same height H2. In some embodiments, H1 is equal to H2. In other embodiments, H1 is less than H2. In further embodiments, H1 is greater than H2. These different embodiments allow products of different heights to be packaged in separate rows in display 10.

Figure 4:
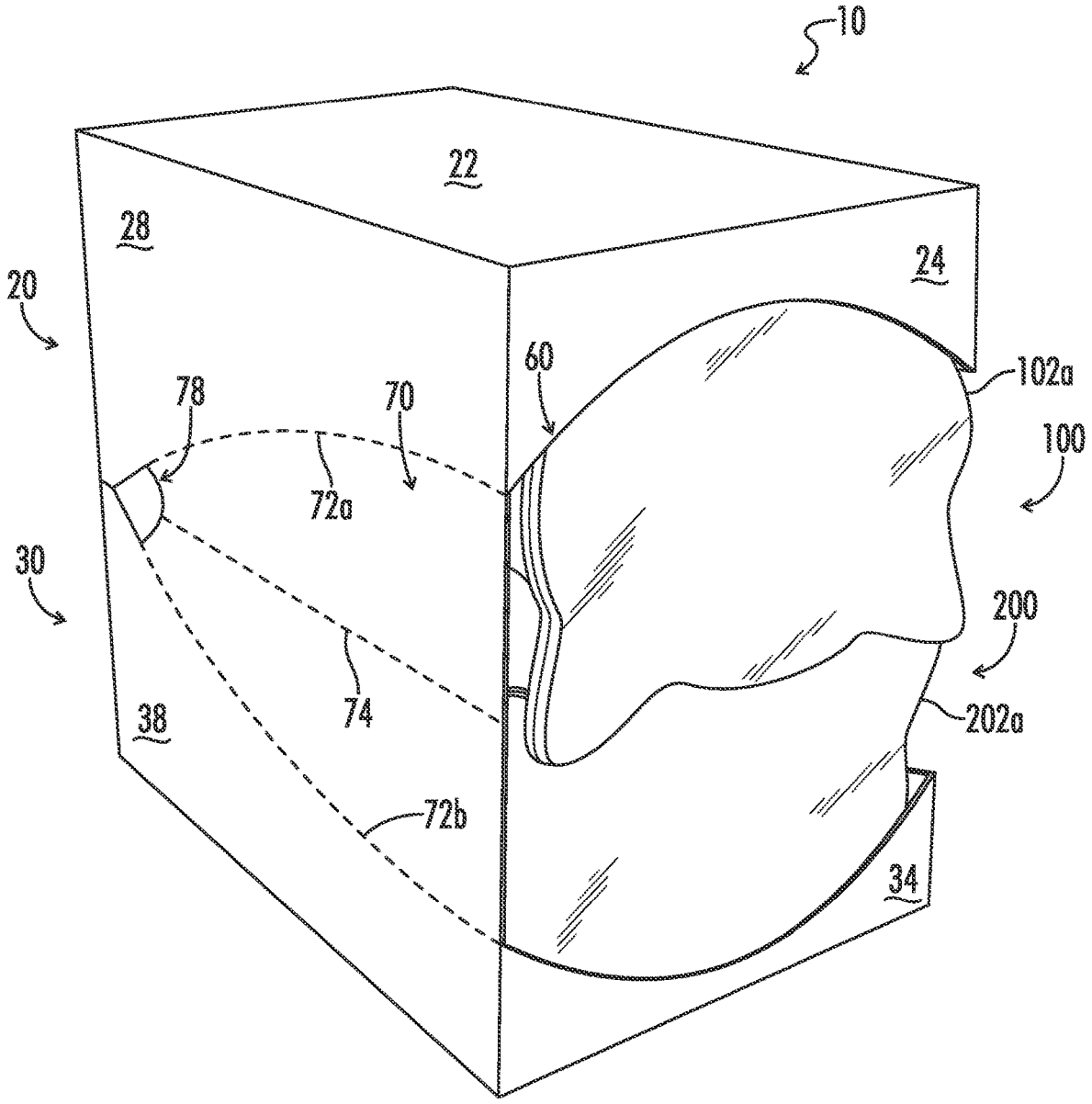
FIG. 4 is a left side perspective view of an embodiment of a multi-unit shelf-ready packaging display in a partially open configuration in accordance with the present disclosure.
Figure 7:
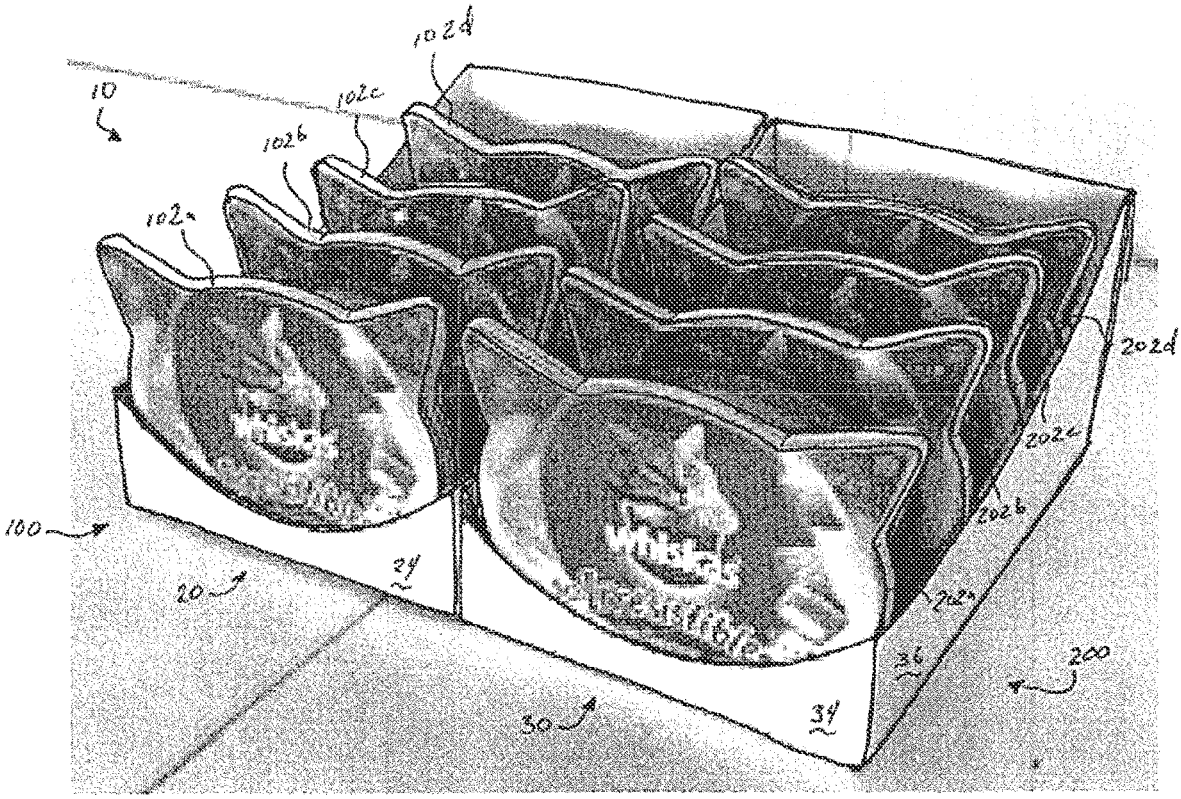
FIG. 7 is a right side perspective view of an embodiment of a multi-unit shelf-ready packaging display having first and second trays positioned side-by-side in accordance with the present disclosure.

In other applications, it may be desirable to place first and second trays 20, 30 with associated products in a side-by-side configuration on a shelf, as shown in FIG. 7. Referring to FIGS. 3-5, in other embodiments, such as a side-by-side display of first and second trays 20, 30, secondary tear panel 70 may be left intact on the left side of display 10 to facilitate a side-by-side placement. In reverse configurations, secondary tear panel 70 may be left intact on the right side of display 10 to facilitate a side-by-side placement.

Referring to FIG. 4, once the primary tear panel 40 is removed, the first and second sets of products 100, 200 are visible in a stacked configuration where the first row 100 is inverted relative to the second row 200. From this configuration, the first tray 20 together with the first set of products 100 may be rotated down and may pivot along fold line 74 in some applications. During this transformation, rear fold 12 is torn to separate the back sides of first and second trays. By pivoting first and second trays 20, 30 along fold line 74, a side-by side display may be formed including a living hinge along the fold line 74.

Alternatively a side-by-side configuration of first and second trays 20, 30 may be achieved by completely removing first and second tear panels 40, 70, and also separating first and second trays by tearing along rear fold 12. For a side-by-side configuration, removal of secondary tear panel 70 is optional depending on what type of display configuration a user seeks. If secondary tear panel 70 is kept intact during the folding of first and second trays 20, 30 along fold line 74, the first and second trays will be attached along a living hinge formed in secondary tear panel 70 along fold line 74. In alternative embodiments, secondary tear panel 70 is completely removed, and first and second trays 20, 30 are separated entirely and are placed in a side-by-side display configuration as shown in FIG. 7.

Referring further to FIG. 7, first tray 20 includes a first set of products positioned in first tray 20 ready for display on a shelf. For example, first tray includes first tray products 102*a*, 102*b*, 102*c*, 102*d*. In other embodiments, first tray 20 includes fewer or more products as compared to those shown in FIG. 7. Each item in first tray 20 is oriented in position for display, such as shown in FIG. 7 with a label facing outward to be easily viewed by a customer when first tray 20 is positioned on a store shelf. Similarly, second tray 30 includes a second set of products positioned in second tray 30 ready for display on a shelf. For example, second tray 30 includes second tray products 202*a*, 202*b*, 202*c*, 202*d*. In other embodiments, second tray 30 includes fewer or more products as compared to those shown in FIG. 7. Each item in second tray 30 is oriented in position for display, such as shown in FIG. 7 with a label facing outward to be easily viewed by a customer when second tray 30 is positioned on a store shelf In some applications, a user seeking to purchase multiple units of first products 102 or second products 202 may simply handle the entire first tray 20 or second tray 30 as opposed to unpacking individual items from each tray on a store shelf. For example, many products are of a nature that a customer typically purchases several at a time. The first and second trays 20, 30 in the multi-unit shelf-ready packaging display 10 provide a convenient form for a customer to easily pick up multiple units at the same time and place an entire tray with products in a shopping cart or basket.

Figure 9:
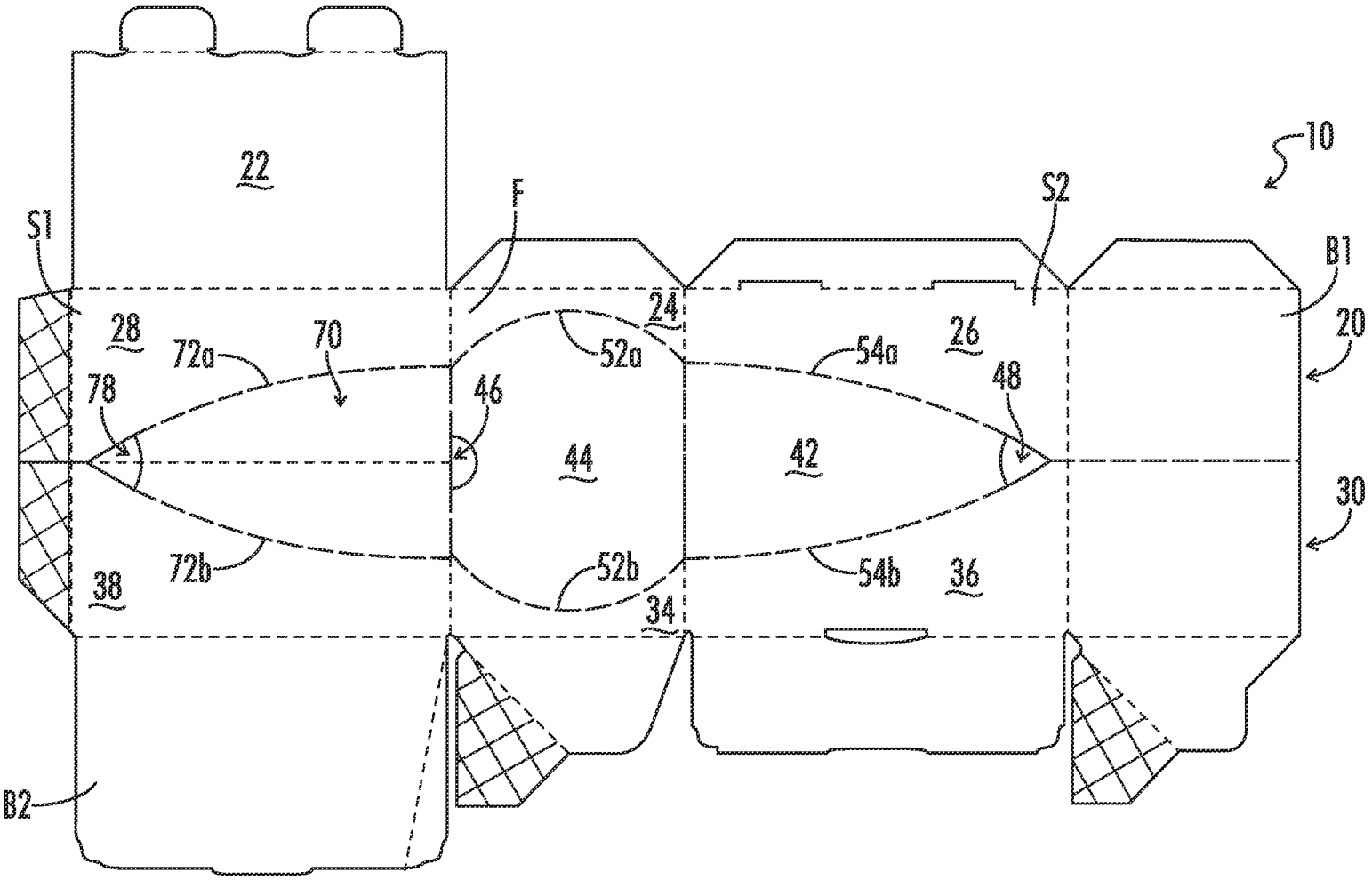
FIG. 9 is a plan view of an embodiment of a layout for a multi-unit shelf-ready packaging display in accordance with the present disclosure.

Referring to FIG. 9, an example of a flat layout for a display 10 in accordance with the present invention is disclosed. Display 10 includes a single sheet of case material configured for folding into a case shape. In some embodiments, display 10 includes a multi-layer sheet with a doppel layer. Display 10 includes a front panel F, a first side panel S1, a second side panel S2, a back panel B, a top panel 22 and a bottom panel B. Front panel F includes a first tray front 24 and a second tray front 34. A primary tear panel front section 44 and a first primary tear panel pull slot 46 is defined on front panel F. Front panel F also includes an upper primary tear panel perforation 52*a* and a lower primary tear panel perforation 52*b*.

As shown in FIG. 9, front panel F is adjacent to a first side panel S1 on one side and a second side panel S2 on the opposite side. Front panel F includes a primary tear panel front section 44 and a primary tear panel pull slot 46. Second side panel S2 includes a primary tear panel side section 42 bordered by an upper primary tear panel side perforation 54*a* and a lower primary tear panel side perforation 54*b*. A second primary tear panel pull slot 48 is defined on the second side panel S2 at the intersection of the upper and lower primary tear panel side perforations 54*a*, 54*b*. Second side panel S2 also includes a first tray right side 26 and a second tray right side 36.

As shown in FIG. 9, first side panel S1 joins front panel F and includes a secondary tear panel 70. Secondary tear panel 70 includes an upper secondary tear panel perforation 72*a* and a lower secondary tear panel perforation 72*b*. A secondary tear panel pull slot 78 is defined in the secondary tear panel 70 at the intersection of the upper and lower secondary tear panel perforations 72*a*, 72*b*. Secondary tear panel 70 also includes a fold line, or crease 74, along which first and second trays may be folded for a side-by-side display. First side panel S1 includes a first tray left side 28 and a second tray left side 38.

A back panel B1 is positioned on display 10 adjacent second side panel S2. Back panel B1 includes a rear fold line 12 along which first and second trays 20, 30 may be folded or fully separated. Additional flaps are shown in FIG. 9 to facilitate joining the panels together to form an enclosed case for packaging units. A top panel 22 and a bottom panel B2 are also disposed on display 10. Once the sheet material for display 10 shown in FIG. 9 is cut, printed, perforated and/or creased where desired, the package may be folded and assembled to form an empty display. Following assembly, the package may be filled with first and second rows of products, 100, 200 as shown in FIG. 8.

By providing a multi-unit shelf-ready packaging display 10 with reduced sacrificial waste material it is possible to reduce unit weight and volume over conventional packaging. Additionally, a multi-unit shelf-ready packaging display 10 that may be opened to form first and second trays capable of vertical stacking provides more efficient usage of allotted space on retail shelves. In many applications, it is desirable to provide a multi-unit shelf-ready packaging display 10 that can be stacked vertically, side-by-side or back-to-back giving several options when separated into individual trays.

In further embodiments, the present invention provides a method of displaying a product, comprising: providing a case including a first tray and a second tray, wherein the first tray is inverted relative to the second tray, the case including a primary tear panel and a secondary tear panel; placing a first set of products in the first tray and a second set of products in the second tray, wherein the first set of products is inverted relative to the second set of products; shipping the case to a point of sale; removing the primary and secondary tear panels; separating the first tray and first set of products from the second tray and second set of products; and vertically stacking the first tray and first set of products above the second tray and second set of products. The method further includes wherein the second set of products supports the first tray and first set of products in the vertically stacked position.

Figure 10:
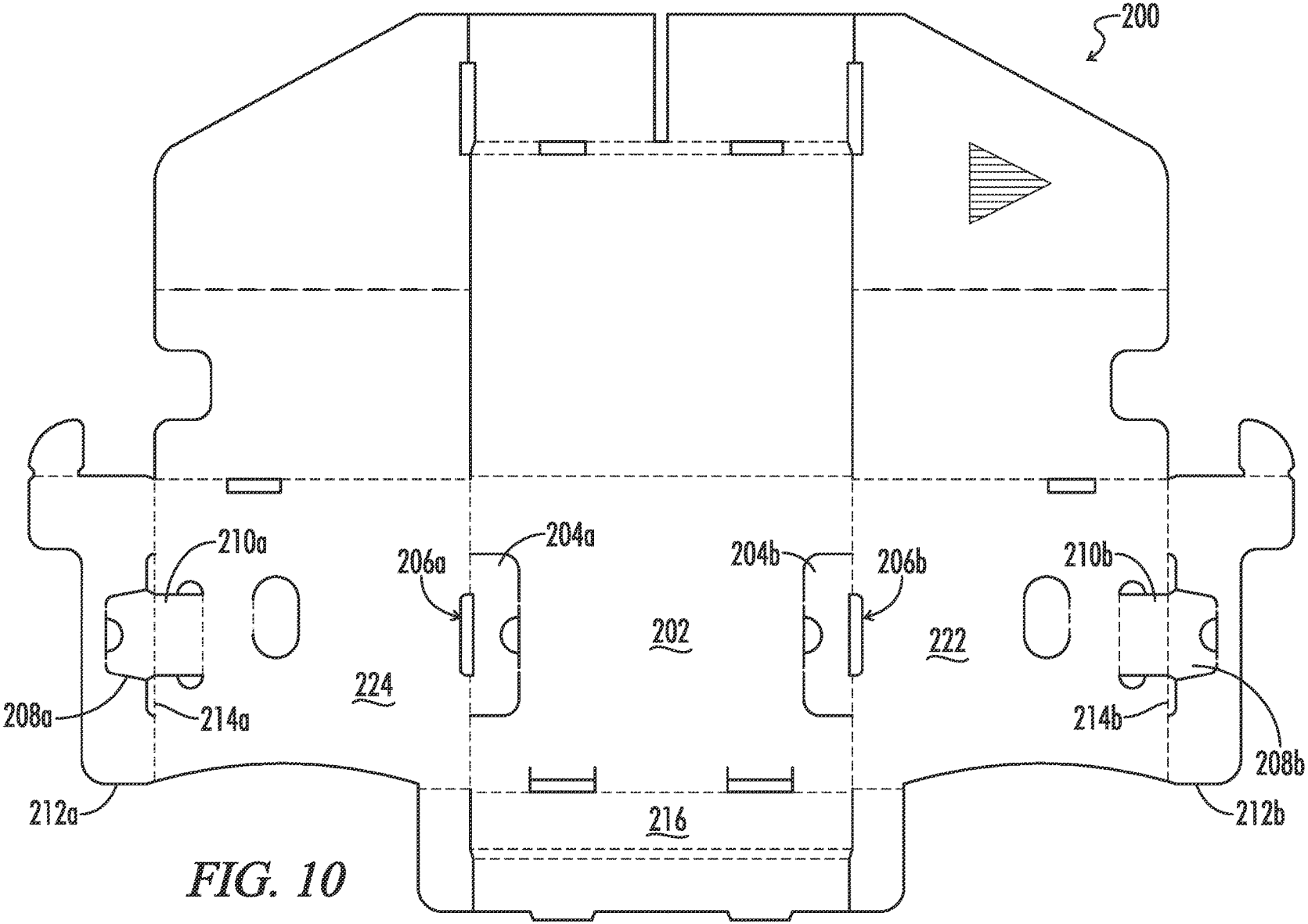
FIG. 10 Is a plan view of an embodiment of an alternative layout for a multi-unit packaging display with locking tabs in accordance with the present disclosure.
Figure 11:
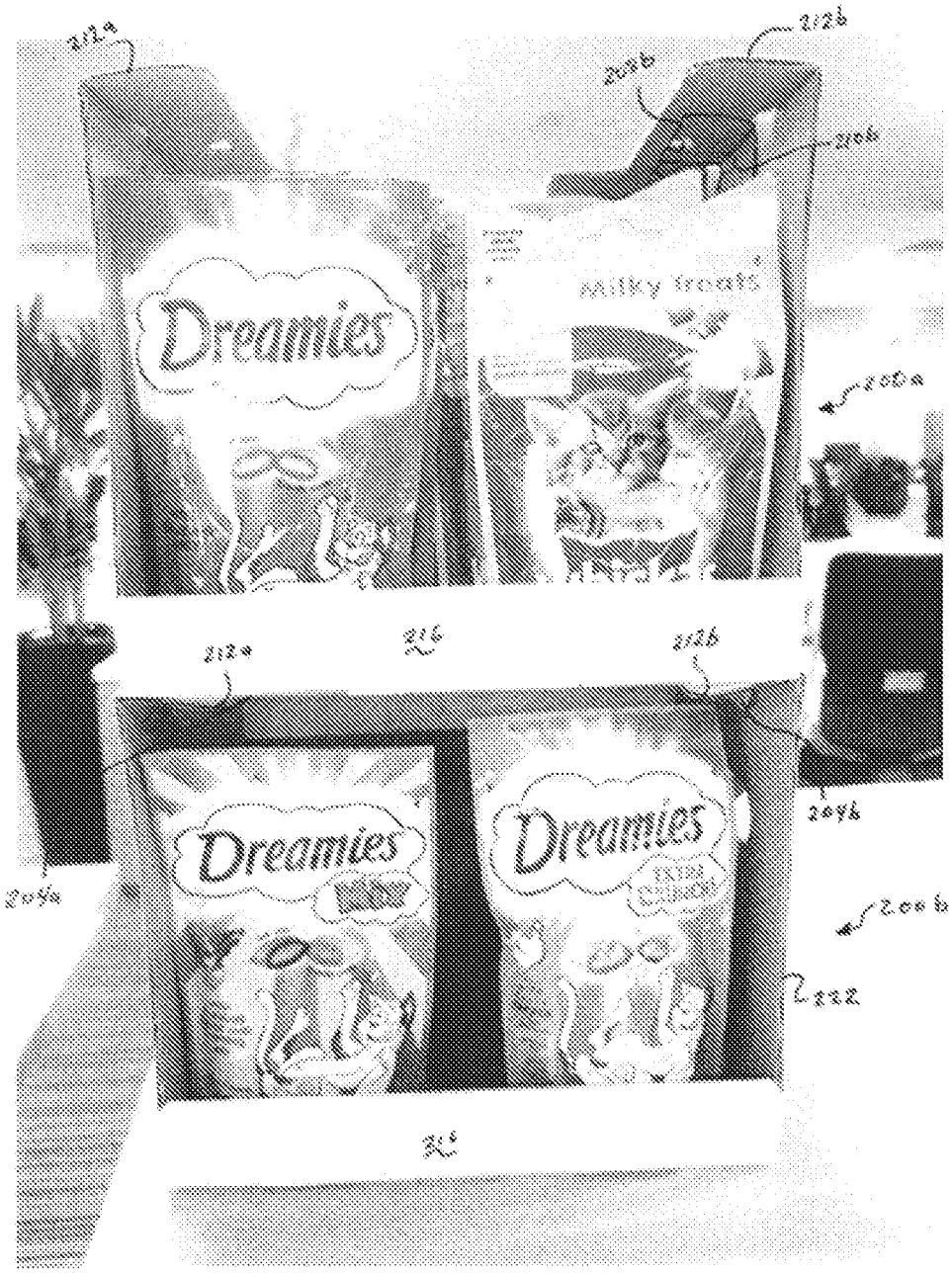
FIG. 11 is a perspective front view of an embodiment of two multi-unit shelf-ready packaging displays in a vertically stacked configuration in accordance with the present disclosure.

Referring further to FIG. 10 and FIG. 11, additional embodiments include a multi-unit shelf-ready packaging display configured for vertical stacking. The apparatus includes a first display 200 including a bottom 202. Bottom 202 is configured to allow first and second bottom locking tabs 204*a*, 204*b* to protrude downwardly from bottom 202 when first and second sides 222, 224 are folded upright at about ninety degrees relative to bottom 202. When first and second sides 222, 224 are folded upright relative to bottom 202, first bottom locking tab 204*a* may pivot away from bottom 202 into a downward orientation, protruding as a flange from the bottom 202. Similarly, second bottom locking tab 204*b* may pivot away from bottom 202 into a downward orientation, protruding as a flange from the bottom 202.

First and second bottom locking tabs 204*a*, 204*b* are positioned to engage corresponding upper slots 214*a*, 214*b* on the upper edge of a like display. For example, when first upper flap 212*a* is folded relative to side 224, a perforation along first upper flap 212*a* causes a first upper slot 214*a* to open. Similarly, when second upper flap 212*b* is folded relative to side 222, a perforation along second upper flap 212*b* causes a second upper slot 214*b* to open. First and second upper slots 214*a*, 214*b* are dimensioned to receive insertion of first and second locking tabs 204*a*, 204*b*, respectively. Thus, when a first display 200*a* is vertically stacked above a second like display 200*b*, as shown in FIG. 11, first locking tab 204*a* is received downwardly into first upper slot 214*a*, and second locking tab 204*b* is received downwardly into second upper slot 214*b*. First and second locking tabs 204*a*, 204*b* allow multiple displays to be stacked vertically in a more stable configuration. When stacked, front panel 216 may be visible, along with the front of product units housed on the display. In some embodiments each display is configured to include two rows of products, as shown in FIG. 11. In such a vertically stacked configuration, the display box supports the weight of the like display and products positioned above it.

Another feature of an alternative embodiment of a multi-unit stackable display includes a first upper edge tab 208*a* and a second upper edge tab 208*b*. First and second upper edge tabs 208*a*, 208*b* provide an additional engagement between a first and a second display. First upper edge tab 208*a* is formed when first upper flap 212*a* is folded relative to side 224. A perforation in the display material allows first upper edge tab 208*a* to break away from first upper flap 212*a*. First upper edge tab 208*a* is attached to a first hinge 210*a*. First upper edge tab 208*a* may be inserted into a first lower edge slot 206*a* when first and second like displays are stacked vertically. Similarly, second upper edge tab 208*b* is formed when second upper flap 212*b* is folded relative to side 222. A perforation in the display material allows second upper edge tab 208*b* to break away from second upper flap 212*b*. Second upper edge tab 208*b* is attached to a second hinge 210*b*. Second upper edge tab 208*b* may be inserted into a second lower edge slot 206*b* when first and second like displays are stacked vertically.

During use, the upper edge tabs 208*a*, 208*b* and first and second locking tabs 204*a*, 204*b* may be deployed for engaging like display, or may be stowed in their original positions. For example, for a bottom display that sits on a shelf or on a floor, it is desirable to leave the first and second locking tabs 204*a*, 204*b* in a stowed position so bottom 202 can sit flat on a surface without the tabs protruding downwardly. Similarly, for a top display in a stack of like displays, it is desirable to keep the first and second upper edge tabs 208*a*, 208*b* in a stowed position because there is no need to engage a like display on the top. As such, each of first and second upper edge tabs 208*a*, 208*b* and first and second locking tabs 204*a*, 204*b* may be selectively deployable.

It should be noted that although the diagrams herein may show a specific order and composition of method steps, it is understood that the order of these steps may differ from what is depicted. For example, two or more steps may be performed concurrently or with partial concurrence. Also, some method steps that are performed as discrete steps may be combined, steps being performed as a combined step may be separated into discrete steps, the sequence of certain processes may be reversed or otherwise varied, and the nature or number of discrete processes may be altered or varied. The order or sequence of any element or apparatus may be varied or substituted according to alternative aspects. Accordingly, all such modifications are intended to be included within the scope of the present disclosure as defined in the appended claims.

The foregoing description of aspects of the invention aspect has been presented for purposes of illustration and description. It is not intended to be exhaustive or to limit the disclosure to the precise form disclosed, and modifications and variations are possible in light of the above teachings or may be acquired from this disclosure. The aspects were chosen and described in order to explain the principals of the disclosure and its practical application to enable one skilled in the art to utilize the various aspects and with various modifications as are suited to the particular use contemplated. Other substitutions, modifications, changes and omissions may be made in the design, operating conditions and arrangement of the aspects without departing from the scope of the present disclosure as expressed in the appended claims

What is claimed is:

1. A shelf-ready packaging display apparatus, comprising:

a case including an integral first tray and an integral second tray, wherein the first tray is inverted relative to the second tray;

a primary tear panel disposed between the first and second trays, wherein the primary tear panel is removable from the display to partially separate the first and second trays;

a secondary tear panel disposed between the first and second trays, wherein the secondary tear panel is removable from the display to partially separate the first and second trays;

a first set of products disposed in the first tray; and a second set of products disposed in the second tray, wherein the first set of products is inverted relative to the second set of products, wherein the first and second trays are vertically stackable relative to each other when the first set of products is positioned in the first tray and the second set of products is positioned in the second tray, and wherein the display is adjustable between a closed shipping configuration and two or more open display configurations, each of the two or more open display configurations requiring at least a removal of the primary tear panel and a reconfiguration of a positioning of at least one of the first tray or the second tray.

2. The apparatus of claim 1, wherein each product of the first set of products includes a first height.

3. The apparatus of claim 2, wherein each product of the second set of products includes a second height.

4. The apparatus of claim 3, wherein the first height and second height are substantially equal.

5. The apparatus of claim 3, wherein the first height and second height are not equal.

6. The apparatus of claim 3, wherein the first tray is supported by the second set of products when the first tray is stacked above the second tray.

7. The apparatus of claim 3, wherein the second tray is supported by the first set of products when the second tray is stacked above the first tray.

8. The apparatus of claim 1, wherein the first tear panel includes a first pull slot and a second pull slot.

9. The apparatus of claim 8, the apparatus further comprising a front side, back side, right side, left side, top and bottom.

10. The apparatus of claim 9, wherein the primary tear panel is disposed on the front side and right side.

11. The apparatus of claim 10, wherein the secondary tear panel is disposed on the left side.

12. The apparatus of claim 11, further comprising a fold line on the secondary tear panel, wherein the first tray is pivotable relative to the second tray along the fold line on the secondary tear panel when the secondary tear panel is on the display.

13. The apparatus of claim 11, further comprising a rear fold defined on the back side of the display, wherein the first tray is pivotable relative to the second tray along the rear fold when the primary and secondary tear panels are both removed from the display.

14. The apparatus of claim 1, wherein the two or more open display configurations include two or more of:

a side-by-side configuration of the first tray and the second tray;

a vertically stacked configuration of the first tray and the second tray; or a double-sided configuration of the first tray and the second tray, wherein adjusting the display to the double-sided configuration results in the first set of products facing a first direction and the second set of products facing a second direction, the second direction being opposite to the first direction.

15. The apparatus of claim 14, wherein adjusting the display to the side-by-side configuration includes:

removing a rear fold, the rear fold connecting a back side of the first tray to a back side of the second tray; and pivoting the first tray relative to the second tray along a fold line defined on the secondary tear panel.

16. A display apparatus, comprising:

a box having a first tray and a second tray, wherein the first tray is inverted relative to the second tray, the box including a front side, back side, left side, right side, top and bottom;

a primary tear panel disposed between the first and second trays;

a secondary tear panel disposed between the first and second trays adjacent the primary tear panel; and a rear fold defined on the back side of the box between the first and second trays, wherein the first and second trays are vertically stackable, and wherein the display is adjustable between a closed shipping configuration and two or more open display configurations, each of the two or more open display configurations requiring at least a removal of the primary tear panel and a reconfiguration of a positioning of at least one of the first tray or the second tray.

17. The apparatus of claim 16, wherein the primary tear panel is disposed on the front side and right side of the box.

18. The apparatus of claim 17, wherein the secondary tear panel is disposed on the left side of the box.

19. The apparatus of claim 16, wherein the primary tear panel is disposed on the front and left side of the box.

20. The apparatus of claim 19, wherein the secondary tear panel is disposed on the right side of the box.

* * * * *